US007175522B2

(12) United States Patent
Hartl

(10) Patent No.: US 7,175,522 B2
(45) Date of Patent: Feb. 13, 2007

(54) COMBINATION WAGERING GAME

(75) Inventor: Josef Alexander Hartl, Las Vegas, NV (US)

(73) Assignee: Shuffle Master, Inc., Las Vegas, NV (US)

( * ) Notice: Subject to any disclaimer, the term of this patent is extended or adjusted under 35 U.S.C. 154(b) by 947 days.

(21) Appl. No.: 09/815,181

(22) Filed: Mar. 22, 2001

(65) Prior Publication Data

US 2003/0008697 A1 Jan. 9, 2003

(51) Int. Cl.
*A63F 13/00* (2006.01)
*A63F 1/00* (2006.01)

(52) U.S. Cl. ..... 463/11; 463/12; 463/13; 273/292

(58) Field of Classification Search ..... 273/292, 273/274, 303, 309; 463/12, 13, 25, 26, 27, 463/28, 11
See application file for complete search history.

(56) References Cited

U.S. PATENT DOCUMENTS 5,265,882 A * 11/1993 Malek ..... 273/292
5,377,993 A 1/1995 Josephs ..... 273/292
5,395,120 A * 3/1995 Malek ..... 273/292
5,411,268 A * 5/1995 Nelson et al. ..... 273/292
5,639,092 A 6/1997 Macaisa ..... 273/292
5,660,391 A * 8/1997 Klasee ..... 273/292
5,678,821 A * 10/1997 Hedman ..... 273/274
5,685,774 A 11/1997 Webb ..... 463/13
5,823,879 A * 10/1998 Goldberg et al. ..... 463/42
5,839,731 A * 11/1998 Feola ..... 273/292
5,873,571 A * 2/1999 Vaisman et al. ..... 273/292
5,921,550 A 7/1999 Awada ..... 273/292
5,947,822 A 9/1999 Weiss ..... 463/13
5,988,643 A 11/1999 Awada ..... 273/292
6,012,719 A * 1/2000 Webb ..... 273/292
6,131,908 A * 10/2000 Palmer ..... 273/292
6,131,909 A 10/2000 Chilese ..... 273/292
6,179,292 B1 * 1/2001 Aramapakul ..... 273/292
6,196,548 B1 * 3/2001 Schaefer ..... 273/292

(Continued)

FOREIGN PATENT DOCUMENTS

EP 333338 9/1989

OTHER PUBLICATIONS

Cadaco, Inc., Tripoley: The Original Game of Hearts, Poker, and Michigan Rummy, 1968.*

(Continued)

*Primary Examiner*—Xuan M. Thai
*Assistant Examiner*—Matthew D. Hoel
(74) *Attorney, Agent, or Firm*—Mark A. Litman & Associates P.A.

(57) ABSTRACT

A combination card game allows players to play 3 distinct games using one hand of cards. In a preferred embodiment, players place wagers on an Ante spot to play THREE CARD POKER®, a TRIPOLEY® spot to win odds, and a Best 2 Blackjack spot to play blackjack. A player can bet one, two or all three spots. Next, a three card hand is dealt to each player and to the dealer. If, after viewing his cards, a player has made the Ante wager, that player must make the Play wager or forfeit the Ante wager. A player who beats the dealer's three-card poker hand of Queen high is paid 1 to 1.

42 Claims, 5 Drawing Sheets

U.S. PATENT DOCUMENTS

| | | | | |
|---|---|---|---|---|
| 6,264,200 | B1 * | 7/2001 | Smith | 273/274 |
| 6,273,424 | B1 * | 8/2001 | Breeding | 273/274 |
| 6,334,614 | B1 * | 1/2002 | Breeding | 273/274 |
| 6,345,823 | B1 * | 2/2002 | Webb | 273/292 |
| 6,371,867 | B1 * | 4/2002 | Webb | 463/12 |
| 6,406,024 | B1 * | 6/2002 | Perkins | 273/274 |
| 6,481,719 | B2 * | 11/2002 | Webb | 273/292 |
| 6,523,831 | B2 * | 2/2003 | Webb | 273/292 |
| 6,749,200 | B2 * | 6/2004 | Yurkins | 273/292 |
| 6,854,733 | B2 * | 2/2005 | Webb | 273/292 |
| 6,863,274 | B2 * | 3/2005 | Webb | 273/274 |
| 6,902,167 | B2 * | 6/2005 | Webb | 273/292 |
| 2001/0035610 | A1 * | 11/2001 | Webb | 273/292 |

OTHER PUBLICATIONS

Gibson, Walter B., Hoyle's Modern Encyclopedia of Card Games, 1974, Broadway Books, pp. 32-33, 226-227, 271-272, and 371.*

Scarne, John, Scarne's Encyclopedia of Card Games: All The Rules for All the Games You'll Want to Play, 1983, Harper and Row, pp. 12 and 280-283.*

"Scarne's Encyclopedia of Card Games," by John Scarne, (c) 1973, HarperCollins, poker (pp. 6 to 55, including three-card poker, pp. 28 & 30), blackjack (pp. 278 to 292), three-in-one, also known as Tripoley™ (p. 393), Michigan rummy (pp. 72 to 74), Michigan (pp. 329 to 331).*

Tripoley rules, (c) 1960, Cadaco, Inc.*

Tripoley rules, (c) 2004, Cadaco, Inc., www.cadaco.com/124_TripoleyInstrucEnglish.pdf, downloaded Sep. 20, 2006.*

Cadaco, Inc. webpage for Tripoley, www.cadaco.com/family-fun/tripoley.html, downloaded Sep. 20, 2006.*

Tripoley Rules, www.tripoleyrules.com, downloaded Sep. 20, 2006.*

Wikipedia articles for "Rank of Hands (Poker)" and "Non-Standard Poker Hand," www.wikipedia.org, downloaded Sep. 20, 2006.*

Wizard of Odds article on three-card poker, www.wizardofodds.com/threecardpoker, downloaded Sep. 20, 2006.*

Three-Card Poker, www.ildado.com/three_card_poker.html, downloaded Sep. 20, 2006.*

Ranking of Poker hands, explaining Queen High, www.pokerpages.com/pokerinfo/rank/index.htm, downloaded Sep. 20, 2006.*

Trademark registration of Tripoley™ game, serial No. 71547230.*

Game Rules for "Tripoley".

* cited by examiner

THREE CARD POKER® PAYTABLE

PLAY MUST EQUAL ANTE.

DEALER PLAYS WITH
QUEEN HIGH OR BETTER

WHEN DEALER DOES NOT PLAY
PLAY=PUSH, ANTE PAYS 1 TO 1

WHEN DEALER PLAYS
PLAY PAYS 1 TO 1, ANTE PAYS 1 TO 1

BONUS PAYS

| | |
|---|---|
| STRAIGHT FLUSH | 5 TO 1 |
| THREE OF A KIND | 3 TO 1 |
| STRAIGHT | 1 TO 1 |

BEST 2 BLACKJACK PAYTABLE

IF PLAYER'S BEST 2=21
AND DEALER'S BEST 2=21
PLAYER LOSES

COMBINATION WAGERING GAME

BACKGROUND OF THE INVENTION

1. Field of the Invention

The present invention relates to casino card games, and more specifically, it relates to a combination wagering game for simultaneously playing several card games.

2. Description of Related Art

The games of Poker and Blackjack have each been very popular with casino patrons. These games have been combined in various forms to further heighten their potential for attracting people into casinos.

There are many basic strategies for blackjack, depending on the casino's rules and the number of decks used. The object of the game is to beat the dealer with a total hand count equal to or less than 21. Each face card counts as 10, the aces count as 1 or 11 and the remaining cards have a count corresponding to the number on the card (i.e., 2–10 count cards).

Before any cards are dealt, the player must place a wager. He does this by placing his bet in the form of a chip or chips in the designated space on his designated table position. The dealer then deals two cards to each of the players, and two to himself (one of the dealer's cards is dealt face up and one is dealt face down).

If the player's first two cards are an ace and a 10 or face card, he wins and this hand is called a blackjack. However, if the dealer also has a blackjack, it is a push or a tie, and the wager is returned to the player. A winning blackjack pays the player 3 to 2. All other winning hands pay 1 to 1.

Taking a "hit" means to draw another card (which the player signifies by scraping the table with his cards or a similar hand motion). "Standing" means that the player opts to take no more cards (which the player signals by placing his cards under his wager or moving his hand in a horizontal direction). If the player hits and busts (goes over 21), he immediately turns his cards over and his wager is lost.

The player is allowed to double the bet on his first two cards but must draw one additional card only to improve his hand. This rule is referred to as "doubling down." If the first two cards a player is dealt are a pair, he may split them into two separate hands, transfer the original bet to the first hand, bet the same amount on the second hand and then play them separately. Under some house rules, when Aces are split, the player may receive only one additional card per hand. After splitting, A-10 hands counts as 21 and not as blackjack.

If the dealer's up card is an ace, the player may place an insurance bet, a bet not exceeding one-half his original bet. If the dealer's down card is a 10 or any face card, the player wins 2 to 1 on the insurance bet. Any other card means a win for the dealer. The dealer must draw on 16 and stand on 17. In some casinos, the dealer is required to draw on a soft 17 (i.e., a hand that, due to the presence of an Ace can be valued at 7 or 17).

A well-known board game called Tripoley® combines the games of Hearts, Poker and Michigan Rummy and is played by any number up to nine. The game is manufactured and Distributed by CADACO-ELLIS, INC. Merchandise Mart of Chicago, Ill. Chips are equally distributed to all Players. A standard 52-card deck of regular playing cards is used. To begin the game, each Player places a Chip on each of the nine sections on the Tripoley® layout (i.e., A, K, Q, J, 10 of hearts, K–Q of hearts, 8-9-10 of any suit, Kitty and Pot). The entire deck of cards is dealt to the players (including an extra or "dead" hand, which is not used). It makes no difference if some Players have one more Card than others.

The Player who finds among his HEART Cards the Ace, King, Queen, Jack or Ten, takes the Chips from the corresponding Section (i.e., if you are dealt the Jack of Hearts, take all Chips in the Jack Section). If a Player holds the King and Queen of Hearts, he not only gets the Chips in each of these Sections, but also the Chips in the King-Queen Section. When a Pay Card is in the "dead" hand, the Chips in that Section cannot be claimed. A Player holding the 8-9-10 of ANY single suit (i.e., 8-9-10 Spades) takes the Chips from that Section. The King-Queen and 8-9-10 sequences are not often held, hence a large pile of Chips often accumulates on these Sections. Any Player not claiming his Pay Card winnings before The Poker hand starts, automatically loses his right and the Chips remain for the next hand.

Each Player then uses his five best Cards to make his strongest Poker hand. The remaining cards are set aside, but are not discarded. The Dealer starts the betting, depending on the value of his hand. He can bet, check or pass. All bets and raises are placed in the Pot and the best hand wins all the chips therein.

Players then take up the cards set aside. The dealer starts by laying down in front of him, face up, the lowest card in his hand, and calling it by name. The Player who holds the next highest consecutive card in the same Suit places it in front of him, etc., until the Ace of the Suit originally opened is reached or, because of holding in the "dead" hand, a STOP is reached. That Player must CHANGE Suits, playing the LOWEST Card in any of the other Suits in his hand. Should he be unable to Change Suits, the Player to his left starts. The first to discard all of his Cards wins the Chips in the Kitty. The remaining Players pay the winner one Chip for each Card left in their hands.

The Deal then passes to the left. The Cards are reshuffled and Players ante again to each of the nine Sections, regardless of whether or not the Chips therein were gained on the previous hand.

When the players are ready to stop, a considerable number of Chips may remain on the Tripoley® game layout. To distribute Chips left in the King-Queen and 8-9-10 Sections, five cards are dealt to each Player as a show-down Poker hand. Additional bets may be placed if desired. Another method is to deal out all Cards, including "dead" hand, and proceed as in a MICHIGAN RUMMY game. Any Player discarding an 8, 9, or 10 gets a one-third interest in Chips in that Section. Similarly, the Players-laying down a King or Queen of Hearts gets a one-half interest in the King-Queen combination. Play continues until the Tripoley® Layout is cleared.

Poker is a card game played with a standard fifty-two-card deck in which players bet into a communal pot during the course of a hand, and in which the player holding the best hand at the end of the betting wins the pot. During a given betting round, each remaining player in turn may take one of four actions:

1. check, a bet of zero that does not forfeit interest in the pot;
2. bet or raise, a nonzero bet greater than preceding bets that all successive players must match or exceed or else forfeit all interest in the pot;
3. call, a nonzero bet equal to a preceding bet that maintains a player's interest in the pot; or
4. fold, a surrender of interest in the pot in response to another players's bet, accompanied by the loss of one's cards and previous bets.

Betting usually proceeds in turn in a circle until each player has either called all bets or folded. Different poker games have various numbers of betting rounds interspersed with the receipt or replacement of cards.

Although Poker is usually played with a standard 4-suit 52-card deck, jokers or other wild cards may be added. The ace normally plays high, but can sometimes play low, as explained below. At the showdown, those players still remaining compare their hands according to the following rankings:

Poker hands rank as follows:

1. Royal Flush (A, K, Q, J, 10, all one suit)
2. Straight Flush (i.e., 5 cards of one suit in sequence)
3. Four of a Kind
4. Full House (three of a Kind, and one Pair)
5. Flush (all one Suit but not in sequence)
6. Straight (five cards in sequence of ranks)
7. Three of a Kind
8. Two Pair
9. One Pair Suits are not used to break ties, nor are cards beyond the fifth; only the best five cards in each hand are used in the comparison. The rules of resolving ties in standard poker are complex and are briefly outlined below. If two royal flushes occur, there is a tie and the pot is split equally. If two straight flushes occur, the high card in each hand determines the tie breaker. If the high cards are of equal rank, the pot is split equally. When there are multiple four of a kinds, the highest ranking card takes the pot. When there is a full house, the high ranking three of a kind determines who wins the pot. For a flush, the high ranking card determines who wins the pot. If those cards are equal, the next highest ranking card determines the winner, and so forth. High card determines who wins on two straights. If the high cards are equal, the pot is split. The high three of a kind determines who wins the pot. The highest pair of two pair wins. If the high pairs are of equal rank, the low pair wins. If both pairs are equal in rank, the rank of the fifth card determines who wins the pot. For a single pair, the high pair wins. If the pairs are equal, the high card of the three remaining cards wins. If no player has a pair or better, the single high card takes the pot. If the single high card is tied, the second highest card is the tie breaker. If the second highest card is a tie, subsequent cards are compared. If all cards are of equal rank, the pot is split.

Several variations are possible when playing for low hand (Aces having a value of 1). Some games permit the ace to play low and ignore straight flushes, making the 5, 4, 3, 2, A straight the best possible low hand, even if it makes a straight flush. Other games just reverse the order used for high hands, making 6, 5, 4, 3, 2 of mixed suits the best possible low hand. Still others count straights and flushes against you but let the ace play low, making 5, 4, 3, 2, A best. Note that in most games in which the ace plays low, a pair of aces is lower than a pair of deuces, just as an ace is lower than a deuce.

When a joker is in play, it usually can only be used as an ace or to complete a straight or flush. It cannot be used as a true wild card, for example, as a queen to make Q, Q, 4, 3, X play as three queens. When playing for low, the joker becomes the lowest rank not already held, so 8, 6, 4, A, X is played as 8, 6,4, 2, A, with the joker used as a deuce.

Although true wild cards are rarely seen in a casino, they are a popular way to add excitement to a home game. Wild cards introduce an additional hand, five of a kind, which normally ranks above a straight flush, as well as a royal flush. They can also cause confusion when two players hold the same hand composed of different wild card combinations. The standard rules of poker do not distinguish between such hands, but some players prefer to rank hands using fewer wild cards above less "natural" versions of the same hand.

Another popular casino game is Three Card Poker® table game. The rules of this game are outlines in commonly owned U.S. Pat. No. 5,685,744, titled Method of Playing Card Games, Serial No. 504,023, filed Jul. 19, 1995, and incorporated herein by reference.

It is desirable to combine certain aspects of Blackjack, certain aspects of poker and certain aspects of Tripoley® game in a novel way to provide a casino card game that is both interesting and exciting.

SUMMARY OF THE INVENTION

It is an aspect of the present invention to provide a card game for casino play that combines the well-known games of Blackjack and Poker with a game that pays the players according to posted odds based upon the rank and suit of the cards the player holds.

It is another aspect of the invention to provide a computer video gaming apparatus that embodies a game that combines Blackjack, Poker and game that pays the players according to posted odds based upon the rank and suit of the cards the player holds.

These and other aspects will be apparent to those skilled in the art based on the disclosure herein.

In one example of the invention, players may place up to three wagers, one for each of Three Card Poker® table game, Tripoley® game and Best 2 Blackjack™ game. In one embodiment, each wager may be in any amount according to posted limits. In such an embodiment, and utilizing the pay tables outlined below (house wins on a push 21, no 3:2 blackjack), the casino advantage has been calculated for Best 2 Blackjack game, Tripoley® game and Three Card Poker® table game to be 1.77%, 3.92% and 2.01%, respectively. In cases where the casino advantage is maintained separately with each bet, the bets may be placed independently, and the amounts can vary accordingly.

In another embodiment, the Best 2 Blackjack wager cannot exceed the Tripoley® game Bonus wager. Under this rule, a player must play the Tripoley® game if they play Best 2 Blackjack game. Under such rules, and according to the pay tables outlined below (blackjacks pay 3:2 and dealer/player 21's are pushes) the casino advantage has been calculated for Best 2 Blackjack game, Tripoley® game and Three Card Poker® table game to be −6.4%, 12.7% and 2.01%, respectively. When the casino is at a disadvantage in one or more of the bets, it is preferable to require combined betting to maintain a house advantage.

After the initial wagers are placed, the players and the dealer are each dealt three cards face down. A card shuffler, such as the ACE® Shuffler card shuffler manufactured by Shuffle Master Gaming of Las Vegas, Nev., may be used to supply cards to the game. The players and the dealer look at their own cards. The game may be played with two or more cards and in any order. In one preferred three card embodiment, each player plays Three Card Poker® table game, Tripoley® game and then Best 2 Blackjack game in turn. Although not critical, the dealer deals left to right and resolves the wagers from his right to his left. Under such a rule, the dealer starts with the player on his right, and resolves all three games prior to moving to the next player. If a player who has made the Ante wager wants to participate in Three Card Poker® table game, the player must make a Play wager in addition to the three initial wagers or forfeit the Ante wager.

If the dealer's best Three Card Poker® table game hand is less than Queen high, then the player's Play wager is a push and the player's Ante wager is paid one to one. If the dealer's hand is Queen high or greater, then both the Ante and Play wagers are paid one to one if the player's hand beats the dealer's hand.

If the dealer's hand is Queen high or greater, then the player loses both the Ante and Play wagers if the rank of the player's hand is less than the rank of the dealers hand.

If the player's Three Card Poker® table game hand is the same as any predetermined bonus hand, such as one of the bonus hands shown under the heading of "BONUS PAYS" on the paytable, then the player is paid according to the listed odds, regardless of the dealer's hand.

The dealer resolves the Three Card Poker® table game wager, then evaluates the same cards for the Tripoley® game bet. If a Tripoley® game wager was placed, the dealer next checks to see whether the player's cards are listed on the Tripoley® game paytable. If the player's cards are listed on the Tripoley® paytable, then the player is paid according to the listed odds regardless of the dealer's hand.

Next, the same cards are used to play Best 2 Blackjack. If the player made the blackjack wager and if the dealer's Best 2 Blackjack (B2BJ) game hand is equal to 21, the dealer reconciles the B2BJ hand the player loses his wager, in some embodiments.

If the dealers B2BJ hand does not equal 21, then the dealer resolves the B2BJ hand by comparing the player's B2BJ hand to the dealer's B2BJ hand. If the player has a blackjack, he is paid 3 to 2 in some embodiments. If the player's total is greater than the dealer's total, the player is paid 1 to 1 with respect to the player's B2BJ wager. If the player's total is equal to the dealer's total, the wager is a push, except when the dealer's total is equal to 21, as discussed above. If the player's total is less than the dealer's total, the player loses the B2BJ wager. The order in which the three games are played is unimportant to the invention.

DETAILED DESCRIPTION OF THE INVENTION

Figure 1:
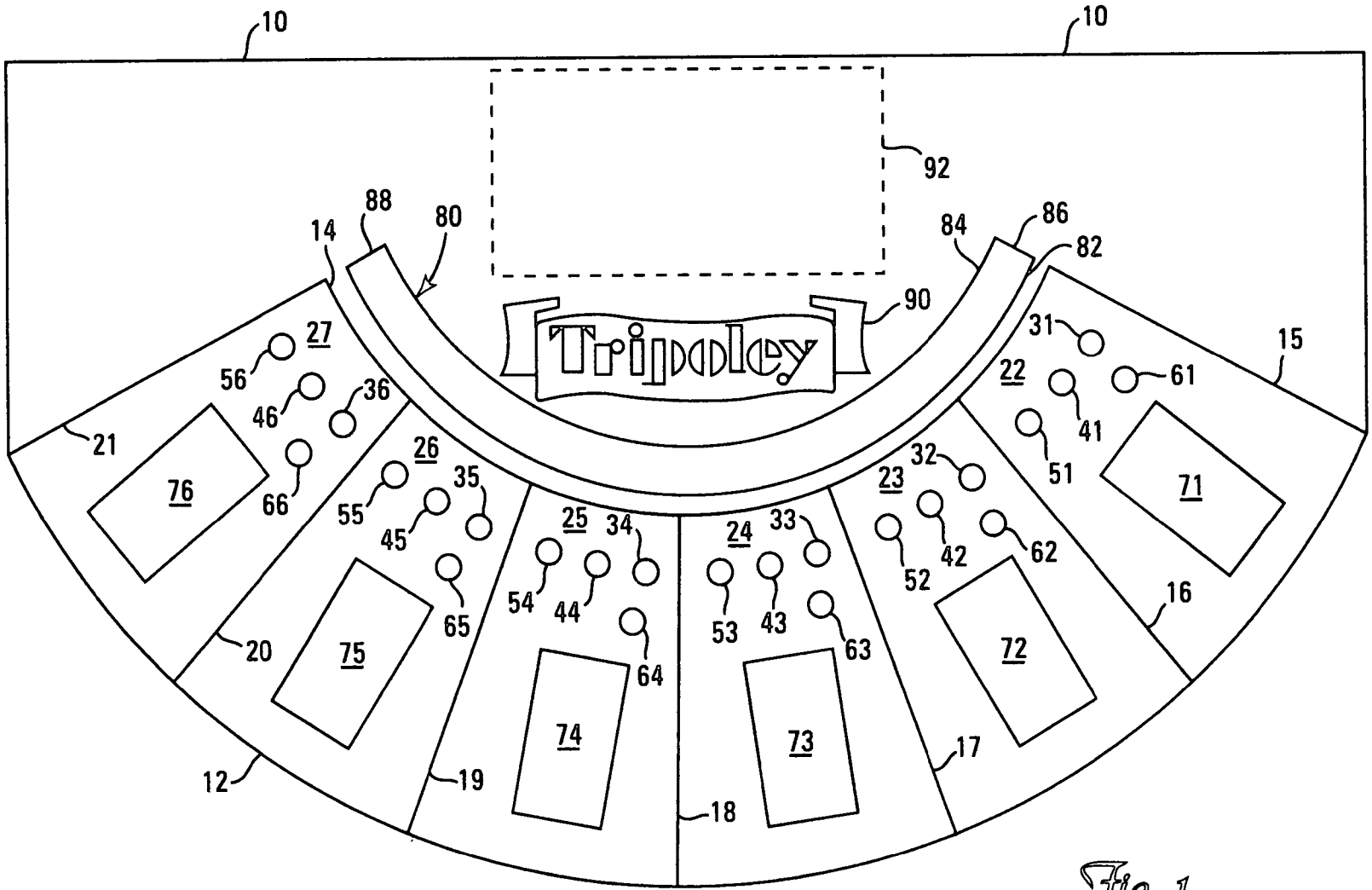
FIG. 1 shows a plan view of an exemplary tabletop semi-circular playing surface on which a game is played according to the present invention.

FIG. 1 shows a plan view of an exemplary tabletop semi-circular playing surface on which a game is played according to the present invention. The surface has a straight edge 10 and a curved edge 12. A dealer is usually positioned next to the surface near the center of edge 10.

The surface may carry a curved line 14 that intersects radial lines 15–21 that connect the edge 12 and the line 14. The edge 12 and the lines 14–21 define the boundaries of six wagering areas.

The edge 12 and lines number 14–16 define the boundaries of a first wagering area 22. The edge 12 and the lines 14, 16 and 17 define the boundaries of a second wagering area 23. The edge 12 and the lines 14, 17 and 18 define the boundaries of a third wagering area 24. The edge 12 and the lines 14,18 and 19 define the boundaries of a fourth wagering area 25. The edge 12 and the lines 14, 19 and 20 define the boundaries of a fifth wagering area 26. The edge 12 and the lines 14, 20 and 21 define the boundaries of a sixth wagering area 27.

In one preferred embodiment, a first player is positioned near the surface next to the wagering area 27. In like manner, second, third, fourth, fifth and sixth players are positioned adjacent to the wagering areas 26–22, respectively.

Each wagering area is substantially identical, and only wagering area 22 will be described in detail. The surface within wagering area 22 includes an indicium 31 near the line 15. As will be discussed in detail below, and particularly with reference to FIG. 2, the indicium 31 is labeled "Ante" and provides a space for the first player to place an ante wager. The tabletop surface includes indicium 32–36 that are similar to indicia 31, within wagering areas 23–27, respectively. Indicium 32–36 are respectively adjacent to the lines 16–20. As shown in more detail in FIG. 2, lettering of the word "ANTE" is provided within the wagering areas 22–27.

The surface within wagering area 22 includes an indicium 61 near the indicium 31 and near the line 15. As will be discussed in detail below, the indicium 61 is labeled "Play" and provides a space for the first player to place a Play wager. The tabletop surface includes indicium 62–66 that are similar to indicia 61, within wagering areas 23–27, respectively. Indicium 62–66 are respectively adjacent to the lines 16–20. Substantially identical to the indicium 61, as shown on FIG. 2, lettering of the word "Play" is provided within the wagering areas 22–27.

Figure 2:
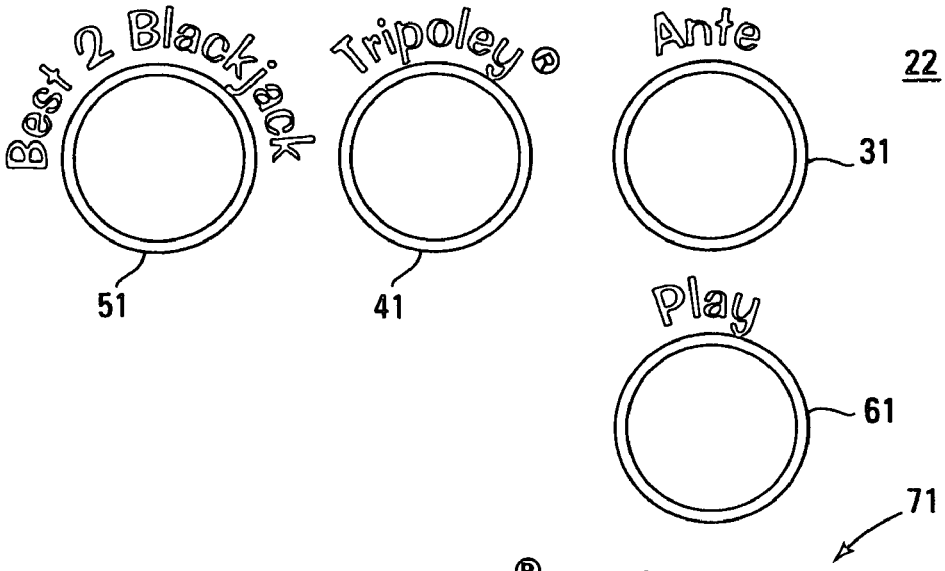
FIG. 2 shows an enlarged view of wagering area 22 of FIG. 1.

The surface within wagering area 22 includes an indicium 41 midway between line 15 and line 16. The indicium 41 is labeled "Tripoley®" and provides a space for the first player to place a Tripoley® game wager as discussed below. The tabletop surface includes indicium 42–46 (shown in FIG. 1) that are similar to indicia 41, within wagering areas 23–27, respectively. Indicium 32–36 are respectively midway between the lines 16, 17, the lines 17, 18, the lines 18, 19, the lines 19, 20 and the lines 20, 21. In like manner as indicium 41, lettering of the word "Tripoley®" is provided above indicium 42–46 within the wagering areas 23–27 as shown in FIG. 2.

The surface within wagering area 22 includes an indicium 51 near the line 16. As will be discussed in detail below, and particularly with reference to FIG. 2, the indicium 51 provides a space for the first player to place a Blackjack wager. The tabletop surface includes indicium 52–56 that are similar to indicia 51, within wagering areas 23–27, respectively (shown in FIG. 1). Indicium 52–56 are respectively adjacent to the lines 17–21. Substantially identical to the indicium 51, as shown on FIG. 2, lettering of the phrase "Best 2 Blackjack" is provided within the wagering areas 22–27.

The surface within wagering area 22 includes text within an area indicated by reference number 71. This text is located midway between lines 15 and 16 and relatively near line 12 as compared to indicium 31, 41, 51 and 61. As will be discussed in detail below, the text indicated by reference number 71 is labeled as shown in FIG. 2, and provides information about the "Three Card Poker®" payout, the "Bonus" payout and the "Best 2 Blackjack" payout. The tabletop surface also includes text within areas indicated by reference numbers 72–76, within wagering areas 23–27, respectively. Text 72 is located midway between lines 16 and 17 and relatively near the line 12 as compared to indicium 32, 42, 52 and 62. Text 73 is located midway between lines 17 and 18 and relatively near the line 12 as compared to indicium 33, 43, 53 and 63. Text 74 is located midway between lines 18 and 19 and relatively near the line 12 as compared to indicium 34, 44, 54 and 64. Text 75 is located midway between lines 19 and 20 and relatively near the line 12 as compared to indicium 35, 45, 55 and 65. Text 76 is located midway between lines 20 and 21 and relatively near the line 12 as compared to indicium 36, 46, 56 and 66. The text within the areas indicated by reference numbers 72–76 is substantially identical to the text within the area indicated by reference number 71, as such text is shown on FIG. 2.

Figure 3:
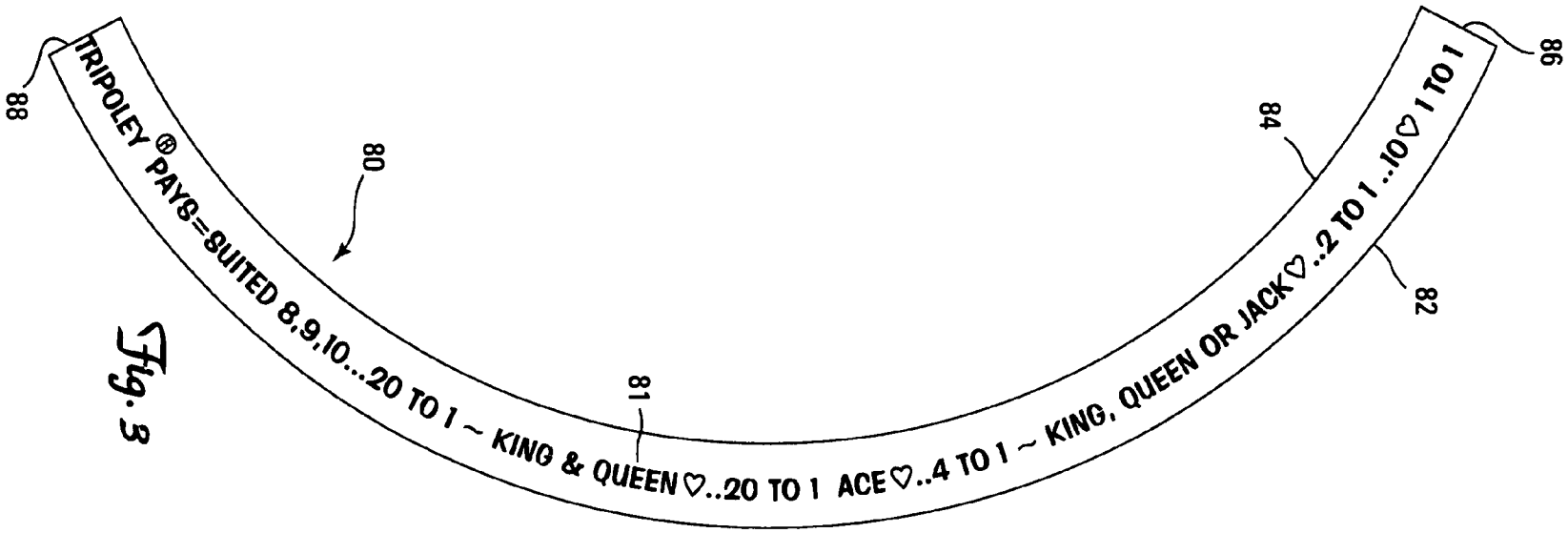
FIG. 3 shows an example of the Tripoley® game payout banner.

As shown in FIG. 3, the surface of the tabletop also includes an arcuate banner 80 having a first curved line 82 near line 14. Banner 80 also includes a second curved line 84 spaced apart from line 82. A line 86 is drawn from one end of line 82 to line 84 and another line 88 is drawn from the other end of line 82 to line 84. As discussed below with reference to FIG. 3, text describing one example of the Tripoley® payout rates and predetermined combinations is located within banner 80.

The table layout shown in FIG. 1 also includes a centrally located banner 90, which includes lettering of the word "Tripoley®". A dealer's area 92 is provided above the banner 90.

Referring back to FIG. 2 is shown an enlarged view of wagering area 22 with the various indicia and text shown. This identical view is also located in wagering areas 23–27. As briefly discussed above, wagering area 22 includes indicium 31, 41, 51 and 61, each labeled "Ante", "Tripoley®", "Best 2 Blackjack" and "Play", respectively. The use of indicium 31, 41, 51 and 61, along with the similar indicium in wagering areas 23–27, will be described in detail below. As shown in FIG. 2, the text 71 states the following:

Three Card Poker ® Paytable

Play must equal Ante.
Dealer plays with
Queen High or better.
When dealer does not play
Play = Push, Ante Pays 1 to 1.
When dealer plays
Play Pays 1 to 1, Ante Pays 1 to 1.
BONUS PAYS Straight Flush . . . 5 to 1
Three of a Kind . . . 3 to 1
Straight . . . 1 to 1
Best 2 Blackjack Paytable If Player's Best 2 = 21
And Dealer's Best 2 = 21
Player Loses The above pay tables and rules (including the bonus hands and payouts) are only examples of the invention, and it is to be understood that payout amounts and the selection of hands defining payouts can be altered, so long as the house retains its advantage.

FIG. 3 shows an enlarged view of the Tripoley® game payout banner 80 of FIG. 1. FIG. 3 further indicates an example of the text 81, which is lettered onto banner 80. In this embodiment, the text 81 indicates that the Tripoley® game payouts are 20 to 1 for suited 8-9-10's, as well as for the King-Queen of Hearts. The payout for the Ace of hearts is 4 to 1. The payout for the King, Queen or Jack of Hearts is 2 to 1 and the payout for the 10 of Hearts is 1 to 1. The Tripoley® game payouts are not critical to the game and can be varied as desired by a casino. However, any changes to payouts will have an effect on the theoretical win odds. It is desirable to provide payouts that always provide the house with an advantage.

Although the term "Tripoley" is being used in this disclosure to describe one segment of play of the game of the present invention, it is to be understood that payouts and combinations in this example of the invention are not strictly identical to those of the conventional Tripoley® game. Any unique combinations of game symbols and payouts that provide a house advantage are contemplated by the "Tripoley" bet, such as runs of hearts (i.e. 2, 3 and 4 of hearts), for example.

The surface within wagering area 22 includes an indicium 31 near the line 15. As will be discussed in detail below, and particularly with reference to FIG. 2, the indicium 31 is labeled "Ante" and provides a space for the first player to place an ante wager. The surface includes indicium 32–36 that are similar to indicia 31, within wagering areas 23–27, respectively. Indicium 32–36 are respectively adjacent to the lines 16–20. As shown on FIG. 2, lettering of the word "ANTE" is provided within the wagering areas 22–27.

The above described top plan view is but one example of a table surface upon which the game may be played according to the present invention. It should be understood that the game may be played in accordance with the present invention on a variety of table layouts, and can even be played on an unmarked table.

The present example of the invention is a combination wagering game, and is referred to herein as "Tripoley®". In one embodiment, each player places up to three wagers in any amount in accordance with posted table minimum and maximum limits to play Three Card Poker® table game, Tripoley® game and/or Best 2 Blackjack game. In another example, the three wagers may be unequal. In such an embodiment, the casino advantage has been calculated for Best 2 Blackjack game, Tripoley® game and Three Card Poker® table game to be 1.77%, 3.92% and 2.01%, respectively.

In another embodiment, the Best 2 Blackjack game wager cannot exceed the Tripoley® game Bonus wager. Under this rule, a player must play Tripoley® if they play Best 2 Blackjack game. Under such rules, the casino advantage has been calculated for Best 2 Blackjack game, Tripoley® game and Three Card Poker® table game to be −6.4%, 12.7% and 2.01%, respectively. Since the casino advantage on the first game is negative, the rule is in place to assure the casino maintains an overall advantage in the game.

The order of the games is not a critical aspect of the invention. They may be played in any order according to a particular set of house rules. It is the object of a preferred embodiment of the game for a player to receive winning outcomes in one to three of these separate games with a single three-card hand. As discussed above, the game could also be played with two or more cards. In a two card game, the player would have to use both of the cards dealt to make up his blackjack hand and would have a very limited number of hands available in a poker hierarchy. The highest-ranking hand would be a pair of aces and the lowest ranking hand would be a 3 and a 2, if the conventional poker hand rankings are used. A greater number of hands become available as the number of cards dealt per hand increases, up to 5 cards; however, embodiments of the present game using more than 5 cards are within the scope of this invention. Additionally, the ranking of the poker hands can take any of the conventionally known poker ranking hierarchies, including low hands and wild cards.

It is to be understood that the number of cards in the game will also alter the win odds, and a mathematical analysis would need to be performed for all modifications to confirm that the house will still possess an advantage when the game is modified.

Figure 4:
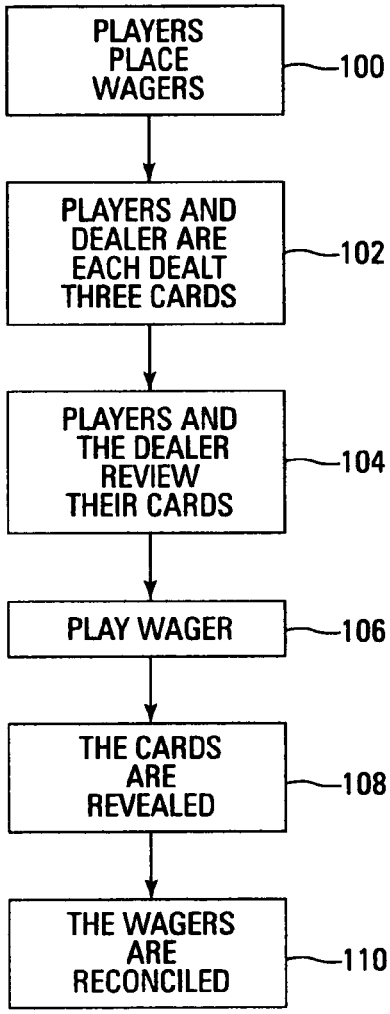
FIG. 4 shows a flow chart of the process of playing an embodiment of the present game.

Referring to FIG. 4, in a three card embodiment of the invention, players place up to three wagers (100), one for each of the Three Card Poker® table game, Tripoley® game and Best 2 Blackjack game. As described above, one form of the game provides that each wager may be in any amount according to posted limits. In another form, the Best 2 Blackjack wager cannot exceed the Tripoley® game wager. In yet another embodiment, the players can make equal or unequal wagers.

The players and the dealer are each dealt three cards face down (102). In another embodiment, only the dealer's cards are dealt face down. A card shuffler, such as the ACE® Shuffler card shuffler may be used. In a preferred form of the game, the dealer deals the cards from his left to his right.

The players and the dealer look at their own cards (104).

If, after viewing his cards, a player who has made the Ante wager wants to participate in Three Card Poker® table game, the player must now make the Play wager or forfeit the Ante wager (106). Even in forms of the game where the Three Card Poker® table game is not resolved first, the player must make the Play wager before the dealer reveals his cards.

The dealer and the player reveal their cards (108). In the embodiment where only the dealer's cards are dealt face down, the dealer's cards are then revealed.

The dealer reconciles the players' wagers (110) as discussed below. In one form of the game, the dealer resolves the wagers from his right to his left. Although in a preferred form of the game, the dealer deals the cards from his left to his right and resolves the wagers from his right to his left, the order that the dealer deals the cards and resolves the wagers is not a critical aspect of this invention. In one example of the invention, the dealer resolves wagers starting with the player to his or her far right, and resolves all three of the first player's hands before moving to the next player.

Three Card Poker® Table Game

In one embodiment, if the dealer's best Three Card Poker® table game hand is less than Queen high, then the player's Play wager is a push and the player's Ante wager is paid one to one. This rule favors the dealer because it prevents him from paying the player's Play wager unless the dealer has at least Queen high and the player's hand exceeds Queen high.

If the dealer's hand is Queen high or greater, then both the Ante and Play wagers are paid one to one if the player's hand is of higher poker ranking than the dealer's hand.

If the dealer's hand is Queen high or better, then the player loses both the Ante and Play wagers if the player's hand is of a lower rank than the dealer's hand.

The present invention is not restricted to the use of the query whether the dealer holds a queen high or better. The invention contemplates any other desired set of rules for determining whether the player's Ante and Play wager are paid. In another example of the invention, the players hand is resolved against a pay table of predetermined payout combinations and odds, and the players hand is not played against the dealer's hand. In the first example of the invention, players are eligible for a bonus, even if the player's hand does not exceed the dealer's hand, and even if the dealer does not qualify.

If the player's Three Card Poker® table game hand contains the same cards as any of the bonus hands shown under the heading of "BONUS PAYS" on the paytable, then the player is paid according to the listed odds, regardless of the dealer's hand. Other bonus pay tables may be constructed and are contemplated by the invention. To play Three Card Poker® table game, the player must make an Ante wager. The players and dealer are then dealt three cards face down. In one form of the invention, there is no requirement that the player's cards must be dealt face down, only the dealer's cards must be dealt face down. In another form of the invention, all cards must be dealt face down. The player would have no incentive to place the Play wager if he could see that the dealer's Three Card Poker® table game hand outranked the player's hand.

After looking at his cards, a player may place a Play wager on indicia 61 to participate in Three Card Poker® table game. A player who has placed the Ante wager to participate in Three Card Poker® table game must also make the Play wager or will forfeit the Ante wager.

After all players who wish to do so have placed the Play wager, the dealer reveals his cards and reconciles the player's hands. In a preferred form of the game, the dealer will reconcile every wager a first player has made before moving on to the next player's wagers. The only exception occurs when Best 2 Blackjack is played first, and when the dealer's Best 2 Blackjack total equals 21, all of the Best 2 Blackjack wagers made by all players are resolved immediately. It is not a critical aspect of the invention that the dealer reconciles every wager a player has made before moving on to the next player's wagers; however, reconciling each player's wagers in turn accentuates and streamlines the flow of the game.

The dealer resolves the Three Card Poker® table game wager if both the Ante and Play wagers were made. If the dealer's best Three Card Poker® table game hand is less than Queen high, the Play bet is a push and the Ante is paid 1-1. If the dealer's best three-card poker hand is Queen high or better, both the Ante and Play wagers are paid 1-1, if the player's hand beats the dealer's hand. If the dealer's hand beats the player's hand, the house wins both bets.

The Three Card Poker® Bonus Pays, as shown on FIG. 2, are paid if the player's hand contains any of the bonus hands shown on the Bonus Pays paytable, regardless of the dealer's hand.

Tripoley® Game

If the Tripoley® game wager is placed, the dealer examines the player's cards to see if any correspond to the cards listed on the Tripoley® game paytable printed banner 80 of FIGS. 1 and 2. Tripoley® game cards are paid odds as listed on the paytable banner 80, regardless of the dealer's hand. Note that a player who receives the "King & Queen of Hearts" payout of 20 to 1 does not also receive a 2 to 1 payout for the King of Hearts and a 2 to 1 payout for the Queen of Hearts. As discussed above, variations of the Tripoley® game payouts are within the scope of the present invention.

Best 2 Blackjack Game

The players and dealer use their three cards to make the best 2 card Blackjack hand. The dealer resolves the Best 2 Blackjack wager according to blackjack rules. If the dealer's Best 2 Blackjack (B2BJ) hand is equal to 21, the dealer first reconciles the B2BJ hand and all of the players lose their wager.

If the dealers B2BJ hand does not equal 21, then the dealer resolves the B2BJ hand by comparing the player's B2BJ hand to the dealer's B2BJ hand. If the player's total is greater than the dealer's total, and does not bust the player gets paid 1 to 1 with respect to the player's B2BJ wager. The player is paid 3 to 2 if he is dealt a blackjack. If the player's point total is equal to the dealer's total, the wager is a push, except when the dealer's total is equal to a blackjack, as discussed above. If the player's total is less than the dealer's total, the player loses the B2BJ wager. When both the player and the dealer have a blackjack, the dealer wins in one example of the invention, while the bet is a push in another example of the invention.

In one embodiment of the game, the cards are dealt with an ACE® shuffler, which is described in U.S. Pat. No. 6,149,154, titled "Device and Method For Forming Hands of Random Arranged Cards" which is commonly owned and whose specification is incorporated herein by reference. When using the ACE® shuffler, the dealer selects "Tripoley®" and actuates the ENTER button. The first deck is then loaded. After the first deck has shuffled, the second deck is loaded. The ACE® shuffler will then dispense multiple hands of three cards each. Beginning with the position to the dealer's left, three randomly arranged cards are delivered as a group from the ACE® shuffler and are placed face down in front of the player by the dealer at wagering area 22. The ACE® shuffler then dispenses three more cards. The dealer then places them face down in front of the next player, and so forth until all players have received three cards face down. Finally, the dealer places three cards face down at the dealer's station shown as area 92 in FIG. 1. The unused cards are then ejected, and a separate deck is inserted to begin shuffling while the next round of the game takes place.

After the players have looked at their three-card hand, the dealer then looks to see which players have made the Ante wager. If any player that has placed the Ante wager has not placed a Play wager, the dealer then asks such player, "Do you wish to play?" Once the Play wager has been made, the dealer announces, "No more bets." The wagers of the players are then resolved as described above.

In an embodiment that does not utilize the ACE® shuffler, after the players have placed at least one of three wagers, the dealer deals three cards face down to each player and to the dealer. The dealer looks to see which players have made the Ante wager. If a player that has placed an Ante wager has not placed a Play wager, the dealer then asks such player, "Do you wish to play?" Once all Play wagers have been made, the dealer announces "No more bets." The wagers are then resolved as described above.

Although a preferred dealing procedure includes resolving the Three Card Poker® table game/Tripoley® game/Best 2 Blackjack game bets for a single player in that order prior to advancing to the next player, the invention contemplates resolving the bets in a different order for a given player and also resolving one of the bets (e.g., the Three Card Poker® table game bet) with all players before resolving the other bets.

In another example of the invention, players play blackjack, Tripoley® game then Three Card Poker® table game in that order. In yet another example of the invention, players play Tripoley® game, blackjack then Three Card Poker® table game. Playing blackjack first is thought to speed up the game because all blackjack bets can be resolved first when the dealer has a blackjack.

The invention may also be implemented in a computer apparatus configured for playing a card game. A preferred method of play in the practice of this invention is to have the game defined, controlled and played by a player on a mechanical device, especially a software driven computer, as is used with modern casino wagering apparatus known in the art as video wagering devices. It should be understood that manipulations within the computer are often referred to in terms such as creating, connecting, comparing, moving, displaying, determining, uploading, downloading, selecting, playing, and the like, which may be associated with manual operations performed by a human operator as well as with automatic or artificial intelligence driven functions by hardware, software, mixed hardware software functions, or other artificial intelligence systems. The operations described herein, except where manually initiated (such as button pushing, coin or currency manipulation, joy stick manipulation, light wand direction, touch screen manipulation, and the like) are machine operations performed in conjunction with various inputs provided by a human operator or user that interacts with the computer.

In addition, it should be understood that the programs, processes, methods, etc. described herein are not related or limited to any particular computer, software, operating system or apparatus, nor are they related or limited to any particular communication architecture. Rather, various types of general purpose machines may be used with program modules constructed in accordance with the teachings described herein.

Similarly, it may prove advantageous to construct a specialized apparatus to perform the method steps described herein by way of dedicated computer systems in a specific network architecture with hard-wired logic or programs stored in nonvolatile memory, such as read only memory.

Additionally, the methods described herein may be practiced on a universal gaming system apparatus such as that described in co-pending U.S. patent application U.S. Ser. No. 09/405,921 filed on Sep. 24, 1999 titled "Gaming Apparatus for Wagering with Universal Computer Motherboard", which Application is incorporated herein by reference for its disclosure of such architecture, harness, I/O systems, hardware and software.

An Exemplary Operating Environment

The following discussion is intended to provide a brief, general description of a suitable computing environment in which the invention may be implemented. While the invention will be described in the general context of an application program that runs on an operating system in conjunction with a personal computer, those skilled in the art will recognize that the invention may also be implemented in combination with other program modules. Generally, program modules include code, applets, routines, programs, components, objects, data structures, etc., that perform particular tasks or implement particular abstract data types. Moreover, those skilled in the art will appreciate that the invention may be practiced with other computer system configurations, including hand-held devices, multiprocessor systems, microprocessor-based or programmable consumer electronics, LAN (large area networks) networks, WAN (wide area networks) networks, minicomputers, mainframe computers, computerized gaming machines and the like. The invention may also be practiced in distributed computing environments where tasks are performed by remote processing devices that are linked through a communication network. In a distributed computing environment, program modules may be located in both local and remote memory storage devices.

An exemplary non-limiting system for implementing the present invention includes a conventional personal computer (also referred to as a client computer), including a processor or microprocessor, a system memory, and a system bus that couples the system memory to the processor. The system memory may include read only memory (ROM) and random access memory (RAM). A basic input/output system (BIOS) is usually stored in the ROM. The BIOS essentially contains the basic routines that help to transfer information between elements within the personal computer during certain computer operations, such as during start-up. The personal computer further may include a hard disk drive, a magnetic disk drive (e.g., that reads from and writes to a removable disk), and an optical disk drive (e.g., that reads from a CD-ROM disk or reads from or writes to other optical media). The hard disk drive, magnetic disk drive, and optical disk drive may be connected to the system bus by any mechanism such as a hard disk drive interface, a magnetic disk drive interface, and/or an optical drive interface, respectively. The drives and their associated computer-readable media provide non-volatile storage for the personal computer. Although the description of computer-readable media above includes the hard disk drive, a removable magnetic disk and an optical disk, such as a CD, it should be appreciated by those skilled in the art that other types of media which are readable by a computer, such as magnetic cassettes, flash memory cards, digital video disks and tapes, Bernoulli cartridges, and the like, may also be used in the exemplary operating environment.

A number of program modules may be stored in the drives and RAM, such as an operating system and a network browsing program module. In general, the network browsing program module is a tool used to interact with other computers over data networks, such as the Internet and the World Wide Web. The network browsing program module is also a tool capable of using downloadable program modules, such as the puzzle control module, in order to direct operation of the personal computer. The drives and RAM may also store other program modules, and program data (such as image data, player input data, random number generators, comparator data [for comparing hands and comparing results with lookup tables], and other game play data).

The operating system, in conjunction with the BIOS and associated device drivers, may provide the basic interface between the computer's hardware and software resources, the user, and program modules such as the network browsing software module. A user may enter commands and information into the personal computer through a touch pad, button panel, touch screen surface, light wand surface, joy stick, and/or keyboard and an input or pointing device, such as a mouse. Other input devices (not shown) may include a microphone, a joystick, a game pad, a tracking ball, a light wand, a light gun, a satellite dish, a scanner, or the like. If the computer is part of a gaming machine, the computer may be connected to a variety of specialized peripheral devices such as a coin hopper, bill validator, monitor, player controls, ticket printer, or other device specific to gaming applications. These and other input devices are often connected to the processor through a serial port interface, such as a game port or a universal serial bus (USB). A monitor or other type of display device (e.g., public view screen, integrated monitors, serial monitors, grid monitors, and the like, with any imaging format, such as CRT, plasma screen, projection viewing, Liquid Crystal display, etc.) is also connected to the system bus via an interface, such as a video adapter. In addition to the monitor, personal computers typically include other peripheral output devices (not shown), such as printers, peripheral light displays, and speakers.

The personal computer may operate in a networked environment using logical connections to one or more remote programmable devices, such as a remote computer. The remote computer may be a server, a router, a peer device, or other common network node. Typically, the remote computer includes many or all of the elements described relative to the personal computer. In one embodiment of the present invention, the remote computer's memory storage device contains data (such as the game control module and the game data) that may be downloaded to the personal computer. The memory storage device also contains program modules (such as the game server module) that may be used by the remote computer when communicating with the personal computer. This type of format may be particularly desirable where there is related play, as among various similar devices, when associated in a bank of video gaming equipment or when there is a coordinated jackpot function, with numerous video gaming systems engaged in potential jackpot play, within one bank of computers, within one casino, within multiple casinos, or within many different gaming jurisdictions.

The logical connections depicted may include a local area network (LAN) and a wide area network (WAN). Such networking environments are commonplace in casinos, offices, enterprise-wide computer networks, intranets and the global Internet. When used in a LAN networking environment, the personal computer is connected to the local network through a network interface. When used in a WAN networking environment, the personal computer typically includes a modem or other means for establishing communications over the wide area network, such as the global Internet. The modem, which may be internal or external, is connected to the system bus via the serial port interface. In a networked environment, program modules relative to the personal computer, or portions thereof, may be stored in the remote memory storage device. It will be appreciated that the network connections shown are exemplary and other means of establishing a communications link between the personal computer and the remote computer may be used.

As discussed earlier, one embodiment of the present invention is embodied in the game control module within the video gaming apparatus as software, hardware or a combination of software and hardware. The game control module essentially controls the previously discussed game. In one operating environment, the game control module is used in conjunction with a network browsing program module, which is supported by an available operating system. Such as Microsoft Corporation's "WINDOWS 95" or "WINDOWS NT" operating systems, LINUX, UNIX, or the like. However, it should be understood that the invention can be implemented for use with other network browsing program modules and with other operating systems and hardware, such as Microsoft Corporation's "WINDOWS 3.1" operating system, IBM Corporation's "OS/2" and "AIX" operating systems, SunSoft's "SOLARIS" operating system used in workstations manufactured by Sun Microsystem, Hewlett-Packard's "HP-UX" and "RT-UX" operating systems, and the operating system used in "MACINTOSH" computers manufactured by Apple Computer, Inc.

From this brief description, it should be appreciated that operating systems, such as the "WINDOWS 95" and "WINDOWS NT" operating system, are quite complex and provide a wide variety of services that allow users and programs to utilize the resources available in the personal computer. Those skilled in the art will be familiar with operating systems and their various features. For more comprehensive information regarding the "WINDOWS 95" and "WINDOWS NT" operating system and its interaction with programs, the reader may refer to any of a variety of publications, including the "Win32 Programmer's Reference" and "Advanced Windows", both published by Microsoft Press.

Play of the Game

Figure 5:
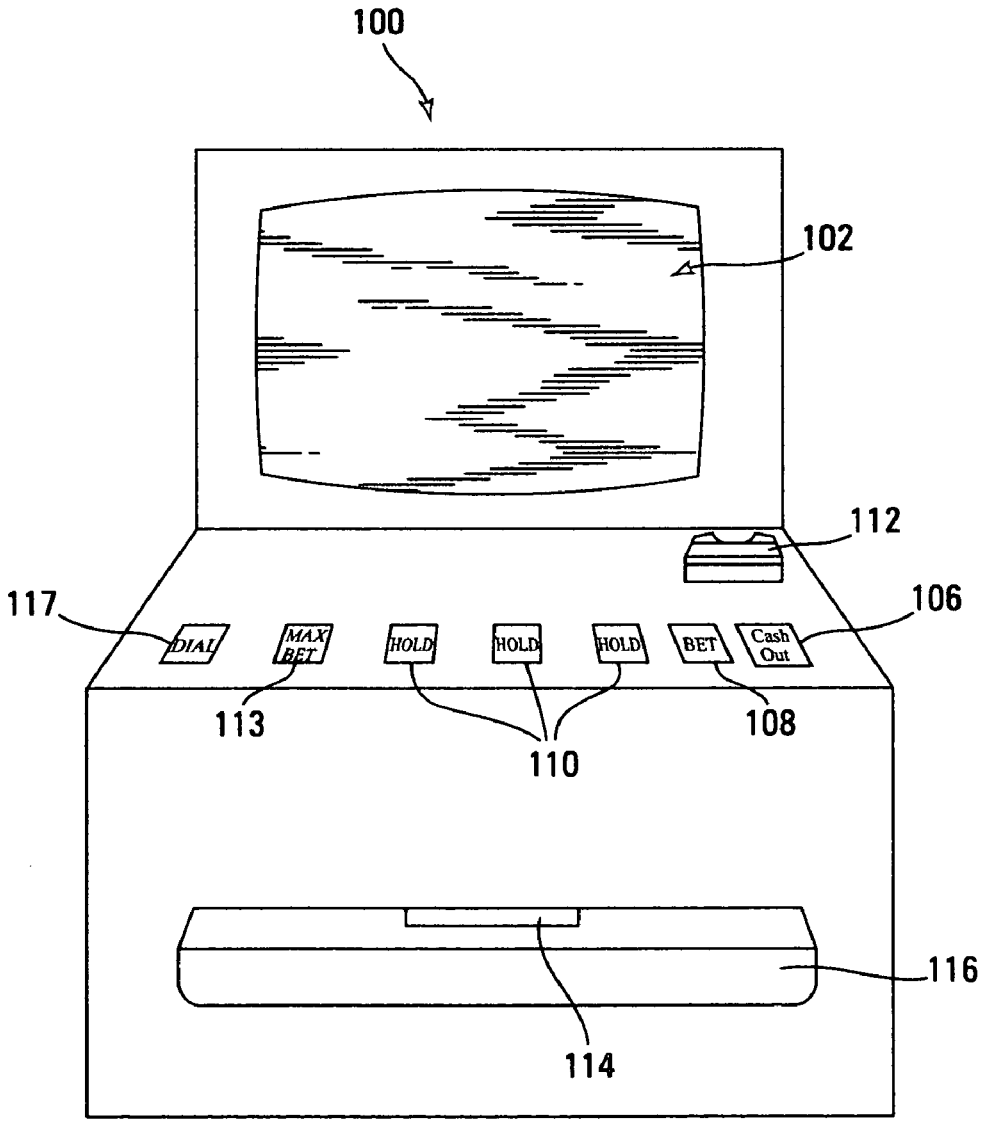
FIG. 5 is a front elevational view of a gaming machine of the present invention.

The following description, in conjunction with reference to FIG. 5, will be provided as a detailed description of the play of a single hand of the multi-part game of the invention, executed on a video gaming apparatus with hardware and software enabling the game.

A player at a video gaming apparatus 100 places a wager in the apparatus or system (by coins, currency, crediting, debiting or the like). In this example, three identical wagers of $0.25 (twenty-five cents) are placed into the play of a single game. A rough view of a video gaming apparatus 100 on which the game of the present invention may be readily played is shown. The apparatus 100 comprises a display panel 102 (e.g., a CRT monitor) having operator control buttons thereon. These buttons may represent any of the operationally player controlled functions such as a cash out button 106, bet one credit button 108, player hold buttons 110, or maximum bet button 113. The apparatus also includes a currency or coin slot/acceptor 112, a hopper 114 and a coin-out tray 116.

Figure 6:
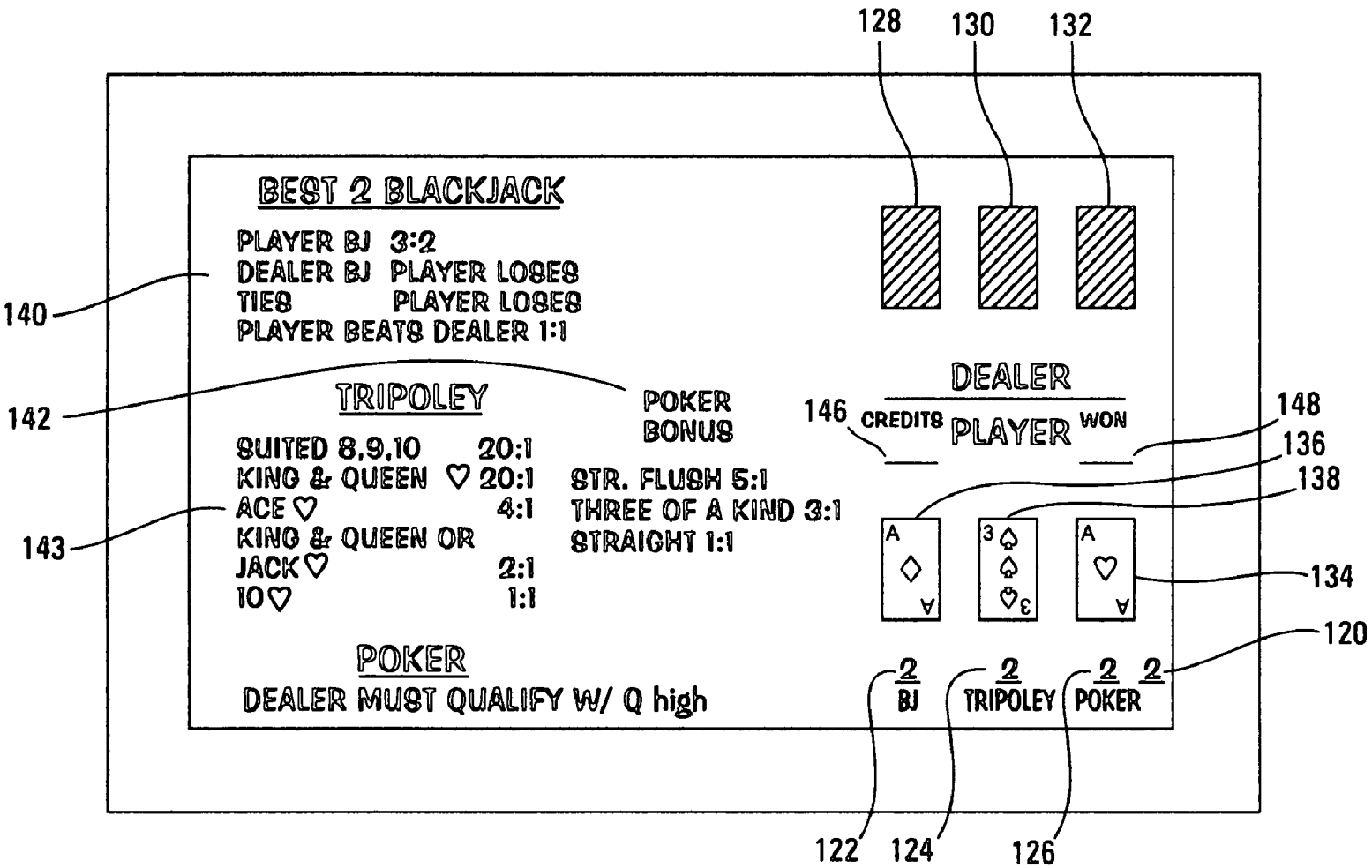
FIG. 6 is an exemplary screen display of the present invention.

Referring to FIG. 6, a set of images displayed on display panel 102 during play of the game are illustrated. Initially, the player and the house are each dealt three cards. The house cards are dealt face down, while the player cards are dealt face up. In this embodiment of the game, the player first decides whether or not to make the play wager. In this example, the play wager is made. The Best 2 Blackjack, Tripoley and Three Card Poker wagers are then resolved, in that order. The player optionally places his bets—in this case he wagered two credits on each game. After he has viewed his cards, he must either fold on the three card poker "ante" bet, or place a "play" bet 120 equal to the ante bet. He decides to play, and places a "play" bet. Both the ante and play bets define the poker bet. If the player decides not to place the play bet, the ante bet is forfeited.

The game is begun, for example, by the player pressing maximum wager button 113 or pressing the wager one credit button 108 the desired amount of times. The deal/draw button 117 is then pressed, or with the maximum bet button 113 being pressed, the deal is automatically started. Upon pressing the maximum bet button 113, (in this example the maximum bet is 2 credits) the maximum wager (of two credits each) for three bet units 122, 124, 126 is displayed.

After the betting has been concluded, the player views his cards, and decides whether to make the play wager. The house hand is then displayed. The cards 128, 130, 132 may be displayed in any manner, turning one card at a time or turning all cards to be face up at the same time. After the complete house hand has been displayed, the resolution and payout of the player hand (comprising cards 134, 136 and 138) is performed, based upon the rules of the three games.

Best 2 Blackjack Game

If, for example, the house hand was a pair of 10's and a 2, the dealer's best 2 blackjack hand is a 20, while the players hand is a 14, with the ace counting as eleven. The player loses the blackjack hand according to the posted rules 140.

Tripoley® Game

Next, the player hand is compared to the Tripoley pay table 143, and is paid 4:1 on the Tripoley bet on the occurrence of the Ace of Hearts.

Three Card Poker® Table Game

Last, since the player has made the "play" wager, his hand is ranked using poker hand rankings. The player has a pair of Aces, while the house has a pair of 10's. Since Aces are of a higher rank than 10's, the player wins 1:1 on both the ante and the play poker bets.

Poker Bonus

Last, the player's hand is evaluated to determine if the hand qualifies for a bonus payout according to the posted pay table 142. In one example of the invention, no additional bonus bet is required. In another example, a separate bonus bet must be placed to participate in the bonus round. Since the player only has a pair, he does not qualify for the bonus. The player hand is then scored as follows:

| Amount Bet | Bet Type | Payout |
|---|---|---|
| 2 | Blackjack | 0 |
| 2 | Tripoley ® | 8 |
| 4 | Poker | 4 |
| — | Bonus | 0 |
| 8 | | 12 |

Credits available to the player may be displayed in area 146, and the number of credits won in the round of play may also be displayed in another location 148.

In one embodiment, a computer comprises input and output devices, computer hardware and software and means for viewing the game. The software includes the steps for performing the game.

The foregoing description of the invention has been presented for purposes of illustration and description and is not intended to be exhaustive or to limit the invention to the precise form disclosed. Many modifications and variations are possible in light of the above teaching. The embodiments were chosen and described to best explain the principles of the invention and its practical application to thereby enable others skilled in the art to best use the invention in various embodiments and with various modifications suited to the particular use contemplated. The scope of the invention is to be defined by the following claims.

What is claimed is:

1. A method of playing a combination wagering game using a standard deck of cards, comprising:

a player making at least one of a) an Ante wager on a first game, the first game being Poker, b) a wager on a second game that a player's hand has designated cards within a suit, the second game being Three-in-One, and c) a wager on a third game, the third game being Blackjack;

a dealer dealing at least two cards to the player and at least two cards face down to the dealer;

playing the games of Poker, Three-in-One, and Blackjack in a preselected order; and resolving all wagers in play, according to respective rules of Poker, Three-in-One, and Blackjack.

2. The method of claim 1, wherein, if the player has made an Ante wager on the Poker game, after the player and the dealer each views his cards, the player makes a Play wager on the Poker game if the player wishes to stay in the Poker game, wherein the Ante and Play wagers together comprise a Poker wager, the player otherwise losing the Ante wager to the dealer.

3. The method of claim 1, wherein exactly two or three cards total are dealt to each of the dealer and the player.

4. The method of claim 1, wherein the game of Blackjack is a game of Best 2 Blackjack, the step of dealing at least two cards to each of the player and the dealer comprises dealing three cards each to the player and the dealer, and a step of resolving a Blackjack Wager includes resolving the Blackjack wager in favor of the dealer if the dealer has a two-card hand count that is equal to 21.

5. The method of claim 1, wherein the step of dealing at least two cards to each of the player and the dealer comprises dealing exactly three cards to each of the player and the dealer, and a step of resolving a Blackjack wager includes resolving the Blackjack wager in favor of the dealer if the player has a two-card hand count that is less than a two-card hand count of the dealer.

6. The method of claim 1, wherein the step of dealing at least two cards to each of the player and the dealer comprises dealing exactly only three cards to each of the player and the dealer, and a step of resolving a Blackjack wager includes resolving the Blackjack wager in favor of the player if the player has a two-card hand count that is greater a two-card hand count of the dealer and the player's two-card hand count does not exceed 21.

7. The method of claim 6, wherein the player is paid an amount at least equal to the Blackjack wager when the player wins the Blackjack game, the Blackjack game being Best 2 Blackjack.

8. The method of claim 7, wherein the player is paid 3 to 2 if the player has a two-card hand count equal to 21.

9. The method of claim 1, wherein a step of resolving a Blackjack wager, wherein the Blackjack game is Best 2 Blackjack, from a hand with a maximum of three cards includes resolving the Blackjack wager as a push if the player has a two-card hand count that is equal to a two-card hand count of the dealer, except when the dealer has a two-card hand count that is equal to 21, wherein the Blackjack wager is resolved in favor of the dealer.

10. The method of claim 1, wherein a step of resolving a Three-in-One wager includes resolving the Three-in-One wager by comparing the cards of the player to a predetermined payout schedule.

11. The method of claim 10, wherein the predetermined payout schedule provides that a Three-in-One payout is at least 20 to 1 for any suited 8, 9, and 10, or for a King of Hearts and a Queen of Hearts; is at least 4 to 1 for the Ace of Hearts; is at least 2 to 1 for a King, Queen, or Jack of Hearts; and is at least 1 to 1 for a 10 of Hearts.

12. The method of claim 2, wherein the step of resolving the Poker wager includes paying the player one to one on the Ante wager and regarding the Play wager as a push when the dealer holds a Poker hand count that is less than Queen High.

13. The method of claim 2, wherein the step of resolving the Poker wager includes paying the player one to one on the Ante wager and the Play wager if the dealer has a Poker hand count that is Queen High or greater and the player has a Poker hand count that is greater than the Poker hand count of the dealer.

14. The method of claim 2, wherein the step of resolving the Poker wager includes the dealer taking the Ante wager and the Play wager if the dealer has a Poker hand count that is Queen High or greater and the player has a Poker hand count that is less than the Poker hand count of the dealer.

15. The method of claim 1, further comprising an additional step of comparing the cards of the player to a bonus pay schedule to determine if the player wins a bonus.

16. The method of claim 15, wherein the bonus pay schedule provides that a straight flush pays 5 to 1, three of a kind pays 3 to 1, and a straight pays 1 to 1.

17. The method of claim 1, wherein an amount of a Blackjack wager cannot exceed an amount of a Three-in-One wager.

18. The method of claim 1, wherein the at least two cards comprise three cards, wherein the Poker game is a game of Three-Card Poker, and wherein the Blackjack game is a game of Best 2 Blackjack.

19. The method of claim 1, wherein the three games are played in the order of Blackjack first, Three-in-One second, and Poker third.

20. The method of claim 1, wherein the three games are played in the order of Poker first, Three-in-One second, and Blackjack third.

21. The method of claim 19, wherein if the dealer has a Blackjack, all Blackjack wagers are resolved prior to playing Three-in-One or Poker.

22. A video gaming apparatus, comprising a microprocessor with memory, wherein the memory comprises means for enabling a player to play a game, the means further comprising:

means for the player making at least one of a) an Ante wager on a first game, the first game being Poker, b) a wager on a second game that a player's hand will have predetermined cards, the second game being Three-in-One, and c) a wager on a third game, the third game being Blackjack;

means for displaying at least two cards and no more than three cards representing a player hand and at least two cards and no more than three cards representing a dealer hand;

means for playing the games of Poker, Three-in-One, and Blackjack in a preselected order; and means for resolving all wagers in play, according to respective rules of Poker, Three-in-One, and Blackjack.

23. The video gaming apparatus of claim 22, wherein, if the player has made an Ante wager on the Poker game, the means for enabling a player to play a game further comprises means for allowing the player to make a Play wager to stay in the Poker game, wherein the Ante and Play wagers together comprise a Poker wager.

24. The video gaming apparatus of claim 23, wherein the means for enabling a player to play a game further comprises means for forfeiting the Ante wager, if one was made, if the player elects not to make the Play wager.

25. The video gaming apparatus of claim 22, wherein the means for allowing a player to play a game further comprises means for turning the dealer's cards face up prior to resolving any wagers.

26. The video gaming apparatus of claim 22, wherein the means for resolving all wagers in play further comprises means for resolving a Blackjack wager, including means for resolving the Blackjack wager in favor of the dealer if the dealer has a two-card hand count that is equal to 21.

27. The video gaming apparatus of claim 22, wherein the means for resolving all wagers in play further comprises means for resolving a Blackjack wager, including means for resolving the Blackjack wager in favor of the dealer if the player has a two-card hand count that is less than a two-card hand count of the dealer.

28. The video gaming apparatus of claim 22, wherein the means for resolving all wagers in play further comprises means for resolving a Blackjack wager, including means for resolving the Blackjack wager in favor of the player if the player has a two-card hand count that is greater than a two-card hand count of the dealer, without exceeding 21.

29. The video gaming apparatus of claim 28, wherein the means for resolving the Blackjack wager further comprises means for paying the player an amount at least equal to the Blackjack wager.

30. The video gaming apparatus of claim 28, wherein the means for resolving the Blackjack wager further comprises means for paying the player 3 to 2 if the player has a two-card hand count equal to 21.

31. The video gaming apparatus of claim 28, wherein the means for resolving the Blackjack wager, further comprises means for resolving the Blackjack wager as a push if the player has a hand count that is equal to a hand count of the dealer, except when the dealer has a hand count that is equal to 21, wherein the Blackjack wager is resolved in favor of the dealer.

32. The video gaming apparatus of claim 22, wherein the means for resolving all wagers in play further comprises means for resolving a Three-in-One wager, including means for resolving the Three-in-One wager by comparing the cards of the player to a predetermined payout schedule.

33. The video gaming apparatus of claim 32, wherein the predetermined payout schedule provides that a Three-in-One payout is 20 to 1 for a suited 8, 9, and 10, or for a King of Hearts and a Queen of Hearts; is 4 to 1 for an Ace of Hearts; is 2 to 1 for a King, Queen, or Jack of Hearts; and is 1 to 1 for a 10 of Hearts.

34. The video gaming apparatus of claim 23, wherein the means for resolving all wagers in play further comprises means for resolving a Poker wager, including means for paying the player one to one on the Ante wager and regarding the Play wager as a push when the dealer holds a Poker hand count that is less than Queen High.

35. The video gaming apparatus of claim 23, wherein the means for resolving all wagers in play further comprises means for resolving a Poker wager, including means for paying the player one to one on the Ante wager and the Play wager if the dealer has a Poker hand count that is Queen High or greater and the player has a Poker hand count that is greater than the Poker hand count of the dealer.

36. The video gaming apparatus of claim 23, wherein the means for resolving all wagers in play further comprises means for resolving a Poker wager, including means for the dealer taking the Ante wager and the Play wager if the dealer has a Poker hand count that is Queen High or greater and the player has a Poker hand count that is less than the Poker hand count of the dealer.

37. The video gaming apparatus of claim 22, wherein the means for resolving all wagers in play further comprises means for comparing the cards of the player to a bonus pay schedule to determine if the player wins a bonus.

38. The video gaming apparatus of claim 37, wherein the bonus pay schedule provides that a straight flush pays 5 to 1, three of a kind pays 3 to 1, and a straight pays 1 to 1.

39. The video gaming apparatus of claim 22, wherein a Blackjack wager cannot exceed a Three-in-One wager.

40. The video gaming apparatus of claim 22, wherein the at least two cards comprise three cards, wherein the Poker game comprises a game of Three-Card Poker, and wherein the Blackjack game comprises a game of Best 2 Blackjack.

41. A method of playing a combination wagering game using a standard deck of cards, comprising:

a player making at least one of a) an Ante wager on a first game, the first game being Poker, b) a wager on a second game that a player's hand will have predetermined cards, the second game being Three-in-One, and c) a wager on a third game, the third game being Best 2 Blackjack;

a dealer dealing exactly and only three cards to the player and exactly and only three cards face down to the dealer;

playing the games of Poker, Three-in-One, and Best 2 Blackjack in a predetermined order; and resolving all bets in play, according to respective rules of Poker, Three-in-One, and Best 2 Blackjack.

42. The method of claim 41, wherein, if the player has made an Ante wager on the Poker game, after the player and the dealer each views his own cards, the player makes a Play wager when he wishes to stay in the Poker game, wherein the Ante and Play wagers together comprise a Poker wager, otherwise the player loses the Ante wager to the dealer.

* * * * *